United States Patent [19]

Persson

[11] Patent Number: 4,591,010

[45] Date of Patent: May 27, 1986

[54] COUPLING BETWEEN A DRILL BIT AND A DRILL SHAFT

[76] Inventor: Jan E. Persson, S-131, 32 Nacka, Sweden

[21] Appl. No.: 784,353

[22] Filed: Oct. 4, 1985

[30] Foreign Application Priority Data

Oct. 10, 1984 [SE] Sweden ..... 8405053

[51] Int. Cl.[4] ..... E21B 17/04

[52] U.S. Cl. ..... 175/320; 175/323

[58] Field of Search ..... 175/320, 323, 329

[56] References Cited

FOREIGN PATENT DOCUMENTS 1203199 10/1965 Fed. Rep. of Germany ..... 175/320

1005844 9/1965 United Kingdom ..... 175/320

*Primary Examiner*—James A. Leppink

*Assistant Examiner*—Terry Lee Melius

*Attorney, Agent, or Firm*—Ostrolenk, Faber, Gerb & Soften

[57] ABSTRACT

The invention relates to a coupling between a drill bit (7) and a drill shaft (6), which at least in an end position in one rotation direction gives an interlocking free from play between the elements, whereby simultaneously the drill bit (7) can be freely rotated in relation to the drill shaft (6) in opposite rotation direction. The drill bit (7) is at the inside provided with a helical spline (11) in which a parallel helical spline (10) arranged on the drill shaft (6) is engaged. The axial motion of the drill bit (7) is delimited by aid of a joint consisting of a peripheric notch (9) cut into the drill shaft (6) and a pin (8) firmly connected to the drill bit (7). The splines (10, 11) have the same pitch s, which is greater than the sum of the spline widths b′+b″, and this brings about that the drill bit (7) can be freely rotated on the drill shaft (6) between two end positions.

10 Claims, 2 Drawing Figures

COUPLING BETWEEN A DRILL BIT AND A DRILL SHAFT

Figure 1:
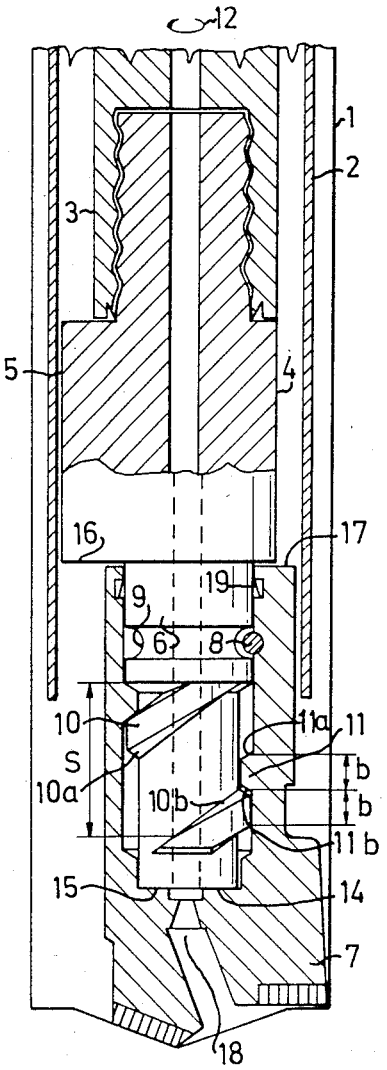

The invention relates to a device for obtaining in two end positions located in angular distance from each other a rigid torque connection in one rotation direction between a drill shaft and a drill bit being in opposite direction freely rotatable on the drill shaft between said end positions, whereby the drill shaft comprises a first abutting means in the first end position being engaged in a first stop means arranged within the drill bit, and a second abutting means in the second end position being engaged in a second stop means arranged in the drill bit.

Couplings of this kind are used between a drill bit and the means transferring energy to the drill bit, when drilling a drill hole, whereby simultaneously the drill hole is lined with a lining tube. The drill bit can by the coupling be turned between a retracted position, whereby it is totally included in the lining tube, and an extended working position, whereby it in part is radially located outside the lining tube. The drill force is via the coupling transferred to the drill bit. As a result of the heterogeneity of the material, the coupling is exposed to considerable varying stresses in the direction of rotation as well as in the direction of the shaft. In percussion drilling the stresses in shaft direction occurring on impact and the arising recoil become particularly large. Admittedly, earlier known couplings allow that the drill bit can be freely turned from the torque transmitting working position to the retracted position, but, in order to meet these requirements, it could not be avoided that there exists a lash between the force transferring coupling parts. This lash has—besides the consequence of an increased impact stress and a wear of material—also led to an overheating of the coupling details with still heavier wear of material and a final collapse as the result. It has been tried to avoid this negative effect by increasing the dimensions of the coupling and hereby to reduce the surface stresses. This measure did not lead to the desired result.

The purpose of the present invention is to eliminate the drawbacks mentioned above and to achieve, at least in one rotation direction, a reliable and durable coupling—free from play—of the drill bit to the drill shaft, whereby simultaneously the drill bit in opposite rotation direction can be freely turned in relation to the drilling rod to a second end position on the drill shaft.

This is solved thereby that the first abutting means of the drill shaft comprises a helical first abutting surface arranged at the circumference, and that the first stop means of the drill bit comprises a helical first stop surface arranged at the interior surface and parallel to the first abutting surface of the shaft, which stop surface in the first end position is engaged in the first abutting surface of the drill shaft, and that limiting means are provided on the drill bit and the drill shaft in order to define in both shaft directions the axial range of movement of the drill bit along the drill shaft.

Figure 2:
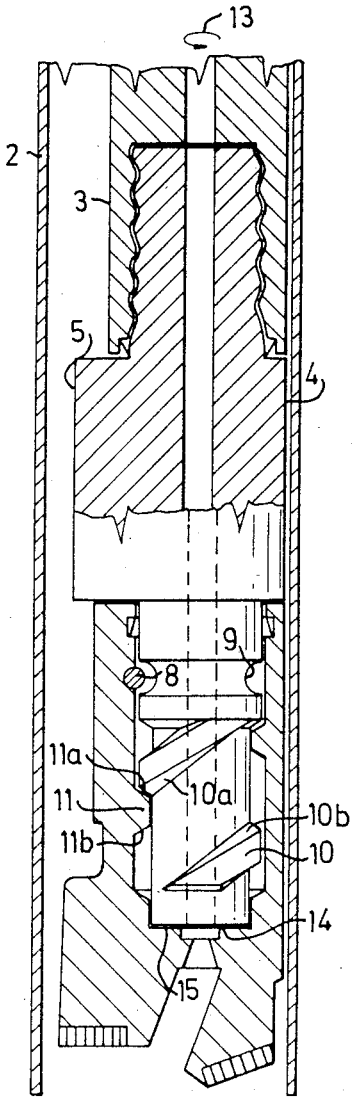

Further properties and advantages of the invention can be seen from the example of the embodiment, which in the following is described with reference to attached drawings, which in FIG. 1 show a section of a drill bit in extended working position on the end of a drill shaft FIG. 2 in a section show the drill bit in retracted position on the drill shaft.

The drill hole 1, which is drilled by the drill bit 7, is during the drilling lined with a lining tube 2, which follows the drill bit 7 down into the hole 1 and prevents a collapse of the drill hole wall. A guide 4 having a contact surface 5 that rests against the inside of the lining tube 2, connects the drill bit 7 with an energy transferring means 3, for instance a drill rod or a sinker bore hammer. The guide 4 continues in a shaft end 6 on which the drill bit 7 is mounted in the form of a hub enclosing the shaft 6. The drill bit 7 is fixed on the shaft 6 by aid of a pin 8 firmly mounted in the drill bit 7, which pin laterally protrudes into a notch 9 extending around the shaft 6. The pin and notch coupling allows the drill bit 7 to be freely turned on the shaft 6, whereby simultaneously the drill bit 7 is axially secured on the shaft 6. When there exists axial play between the pin 8 and the notch 9, the drill bit 7 has a limited axial range of movement on the drill shaft 6.

The drill shaft 6 is provided with a helical spline 10 having two parallel flanks **10*a*, 10*b*, located opposite to each other. The spline 10, which has an axial width b' and a pitch s, co-operates with a helical spline 11 shaped within the drill bit 7 and with the same pitch s as the spline 10 and with an axial width b''. The spline 11 of the drill bit 7 comprises also two parallel flanks 11*a*, 11*b*, located opposite to each other. The pitch s is greater than the sum of the axial widths b'+b'' of the splines 10, 11**—in the example shown in the drawing about twice as great.

When the shaft 6 is rotated in the rotation direction 12, the flank **10*b* will softly bevel against the flank 11*b* on the spline 11 arranged in the drill bit 7 and turn the drill bit 7 being eccentrically retracted in the lining tube 5 to the extended working position shown in FIG. 1. Simultaneously, the axial component of the engagement force between the flanks 10*b* and 11*b* will actuate the drill bit 7 in a direction towards the drill rod 3. The shaft 6 is provided with one or several stop planes 14, 16, against which corresponding pressure planes 15, 17, arranged on the drill bit 7 will be pressed. The stop plane of the shaft 6 can consist of a flange plane 16, or of an end plane 14, or of both, whereby the drill bit 7 is provided with corresponding reaction surfaces, i.e. the annular end plane 17 or the bottom plane 15, respectively of the drill bit 7. On torque transmission the drill bit 7 will thus, free from play, be secured between the force transmission plane and a stop plane provided along the shaft 6**, so that axial forces—drill percussions as well as recoils—can be carried without any occurrence of overheating phenomena and strong wear of material in the force transmission surfaces. The stop surfaces and the force transmission surfaces can moreover be made rather large, which further reduces the surface strain with a diminished material degradation as the result.

When the shaft 6 is turned in opposite direction 13, the spline flank **11*b* of the drill bit 7 is disengaged from the spline flank 10*b* of the drill shaft 6. The pitch s is of course so great that the joint does not become self-locking. Due to the fact that the pitch s is greater than the sum of the spline widths b'+b'', the shaft 6 can be turned an angle before the spline flank 10*a* will get in contact with the spline flank 11*a* of the drill bit. The torsion restriction backwards need not necessarily be obtained by aid of a helical spline coupling, but can be performed by aid of co-operating projections on the shaft 6 and in the drill bit 7, or for instance thereby, that the notch 9 contains a stop shoulder, against which shoulder the pin 8 abuts, because merely an insignificant torque and no axial force need be transferred in this rotation direction 13**.

If the spline flanks 10*a*, 11*a* and 10*b*, 11*b*, respectively constitute the sole torsional restriction and the drill bit 7 is axially fixed on the shaft 6, the free torsion angle $$\alpha=[s-(b'+b'')]\cdot 360°/s$$

is obtained.

The drill bit 7 can thus be turned approximately 180°, when—as in the drawing figure—the sum of the spline widths amounts to half the pitch s. The free torsion angle can be increased by allowing the drill bit 7 a limited axial range of movement on the drill shaft 6, for instance thereby, that the pin 8 with rather large axial play is contained in the notch 9.

In order to increase the operating reliability under difficult conditions and to prevent an infiltration of external impurities, the mechanism is protected on the one hand by a shaft packing 19, and on the other hand by a non-return valve arranged in the scavenging air channel 18.

The present invention is of course not restricted to the shown example. For instance, several splines can be provided in the drill bit and on the shaft, i.e. there exist several entrances. The capacity of transferring the torque increases thereby, but this occurs at the cost of the free torsion angle.

I claim:

1. Coupling for obtaining in two end positions located in angular distance from each other a rigid torque connection in one rotation direction between a drill shaft (6) and a drill bit (7) being in opposite direction freely rotatable on the drill shaft (6) between said end positions, whereby the drill shaft (6) comprises a first abutting means, in the first end position being engaged in a first stop means arranged on the drill bit (7), and a second abutting means, in the second end position being engaged in a second stop means arranged on the drill bit (7), characterized in that the first abutting means of the drill shaft (6) comprises a helical first abutting surface (10*b*) arranged at the circumference, that the first stop means of the drill bit (7) comprises a helical first stop surface (11*b*) arranged on the interior surface and parallel to the first abutting surface (10*b*) of the shaft (6), which stop surface in the first end position is engaged in the first abutting surface (10*b*) of the shaft (6), and that limiting means (8, 9; 14, 15; 16, 17) are arranged on the drill bit (7) and the drill shaft (6) to delimit in both shaft directions the axial range of movement of the drill bit (7) along the drill shaft (6).

2. Coupling according to claim 1, characterized in that the second abutting means of the drill shaft (6) comprises a helical second abutting surface (10*a*) arranged at the circumference, that the second stop means of the drill bit (7) comprises a helical second stop surface (11*a*) arranged on the interior surface and parallel to the second abutting surface (10*a*) of the drill shaft (6).

3. Coupling according to claim 2, characterized in that the abutting means of the drill shaft (6) consists of a helical first spline (10) with the axial spline width b' and the pitch s, whereby the one spline flank forms the first abutting surface (10*b*) of the shaft (6), and the other spline flank forms the second abutting surface (10*a*) of the shaft (6), that the abutting means of the drill bit (7) consists of a helical second spline (11) having the axial spline width b'' and the pitch s, whereby its one spline flank forms the second stop surface (11*a*), whereby the pitch s is greater than the sum of the widths of the first and the second spline b'+b''.

4. Coupling according to claim 1 characterized in that the limiting means comprise a peripheric notch (9) extending, at least partly, around the drill shaft (6), and a shoulder (8) projecting from the drill bit (7) into the notch (9).

5. Coupling according to claim 4, characterized in that the shoulder consists of a pin (8) fixed in the drill bit (7).

6. Coupling according to claims 4 or 5, characterized in that the shoulder or the pin (8) with axial play is contained in the notch (9), so that a limited axial range of movement on the drill shaft (6) is imparted to the drill bit (7).

7. Coupling according to claims 4 or 5, characterized in that the notch (9) comprises a stop butt to delimit the rotary motion of the drill bit (7).

8. Coupling according to claim 1 characterized in that the limiting means comprise one or several stop planes (14, 16) arranged on the drill shaft (6), against which stop planes corresponding pressure planes (15, 17) formed on the drill bit (7) are pressed, when the drill bit (7) by the applied torque and as a consequence of the helical engagement plane in the first end position is influenced by an axially working force.

9. Coupling according to claim 8, characterized in that the axial butt of the drill shaft (6) comprises a flange (16), against which flange an end plane (17) formed as axial stop on the drill bit (7) can butt in the first end position.

10. Coupling according to claims 8 or 9, characterized in that the axial butt of the drill shaft (6) comprises the end plane (14) of the drill shaft (6), whereby the axial stop of the drill bit (7) comprises a bottom plane (15) arranged within the drill bit (7).

* * * * *